US006213479B1

(12) United States Patent
Cochimin

(10) Patent No.: US 6,213,479 B1
(45) **Date of Patent: *Apr. 10, 2001**

(54) CONVERTIBLE IN-LINE/PARALLEL SKATES

(76) Inventor: Jimmy Cochimin, 4431 Fairfield Ave., Fort Wayne, IN (US) 46807

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/089,113

(22) Filed: Jun. 2, 1998

(51) Int. Cl.[7] ..... A63C 17/02
(52) U.S. Cl. ..... 280/7.1; 280/11.22; 280/11.27
(58) Field of Search ..... 280/7.1, 7.12, 280/7.13, 7.15, 841, 11.19, 11.22, 11.23, 11.27, 11.28, 11.3

(56) References Cited

U.S. PATENT DOCUMENTS

| | | | | |
|---|---|---|---|---|
| 177,566 | | 5/1876 | Saladee . | |
| 1,309,493 | | 7/1919 | Tyler . | |
| 1,527,840 | | 2/1925 | Chomin . | |
| 2,035,897 | | 3/1936 | Kosanovich | 208/173 |
| 2,512,524 | | 6/1950 | Gallo, Jr. et al. | 280/7.1 |
| 2,591,534 | | 4/1952 | Gallo, Jr. et al. | 280/7.15 |
| 3,086,787 | | 4/1963 | Wyche | 280/11.19 |
| 3,901,520 | | 8/1975 | McMahan | 280/7.13 |
| 4,382,605 | | 5/1983 | Hegna | 280/11.19 |
| 4,492,385 | | 1/1985 | Olson | 280/7.13 |
| 4,553,767 | | 11/1985 | Robjent et al. | 280/11.21 |
| 4,932,675 | | 6/1990 | Olson et al. | 280/7.13 |
| 4,932,676 | | 6/1990 | Klamer | 280/11.2 |
| 5,193,827 | | 3/1993 | Olson | 280/7.13 |
| 5,295,701 | | 3/1994 | Reiber et al. | 280/11.22 |
| 5,372,534 | | 12/1994 | Levy et al. | 446/457 |
| 5,494,304 | * | 2/1996 | Levy et al. | 280/11.22 |
| 5,524,911 | | 6/1996 | Cochimin | 280/7.1 |
| 5,549,310 | * | 8/1996 | Meibock et al. | 280/11.22 |
| 5,566,957 | * | 10/1996 | Ho | 280/11.22 |
| 5,775,705 | * | 7/1998 | Cochimin | 280/7.1 |

FOREIGN PATENT DOCUMENTS

| | | |
|---|---|---|
| 91 07 661 | 8/1991 | (DE) . |
| PCT/US95/10082 | 7/1995 | (WO) . |

OTHER PUBLICATIONS

U.S. Patent application Ser. No. 08/780,827.

* cited by examiner

*Primary Examiner*—J. J. Swann
*Assistant Examiner*—James S. McClellan
(74) *Attorney, Agent, or Firm*—Baker & Daniels

(57) ABSTRACT

The present invention involves a skate that can be converted from an in-line wheel configuration in which all of the skate wheels are coplanar to a parallel or quad wheel configuration, and vice versa. The skate includes a foot or shoe enclosure, a wheel chassis, a wheel support, at least two wheels, and mechanisms which position the wheel chassis at a center point and allows the wheel chassis to pivot the wheels from an in-line to a parallel configuration. The positioning mechanisms include tie rods, yokes, gear sets, and externally mounted rods or panels. A post on the bottom of the enclosure may include a threaded portion which is engaged by a nut to rotationally secure the position of the wheel chassis, or the post may include a portion of enlarged diameter supporting a spring which biases the wheel chassis into the post. A brake is provided to allow the user to slow or stop the skate in a controlled manner. An alternative embodiment involves a pair of yoke-chassis which both position and align the wheels.

18 Claims, 18 Drawing Sheets

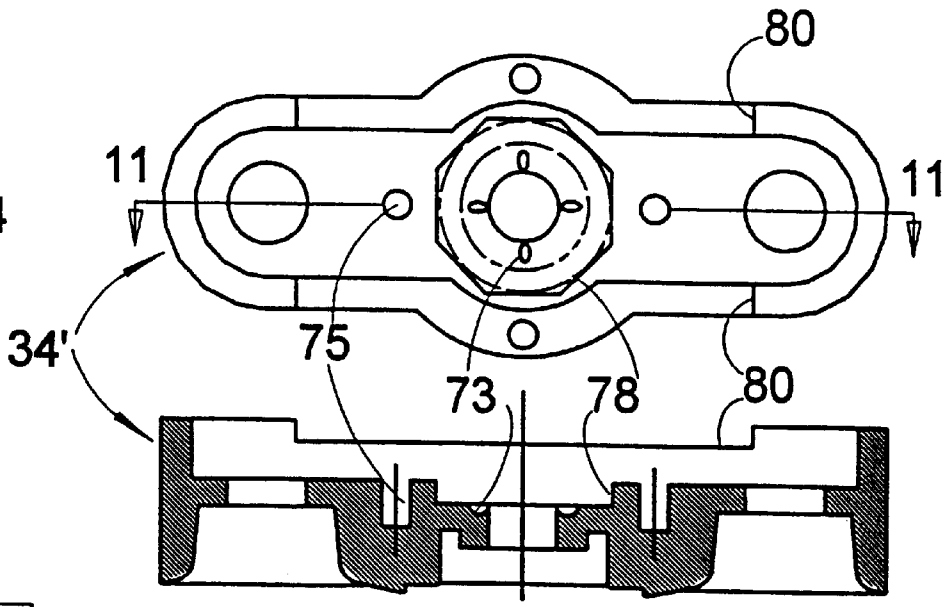
Figure 10
Figure 11
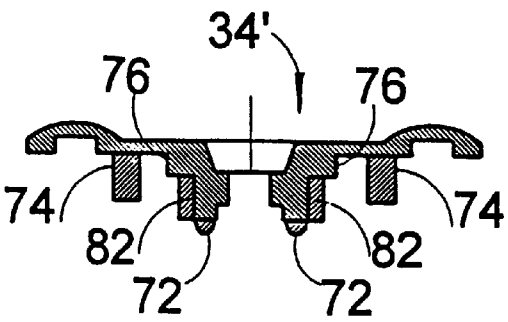
Figure 8
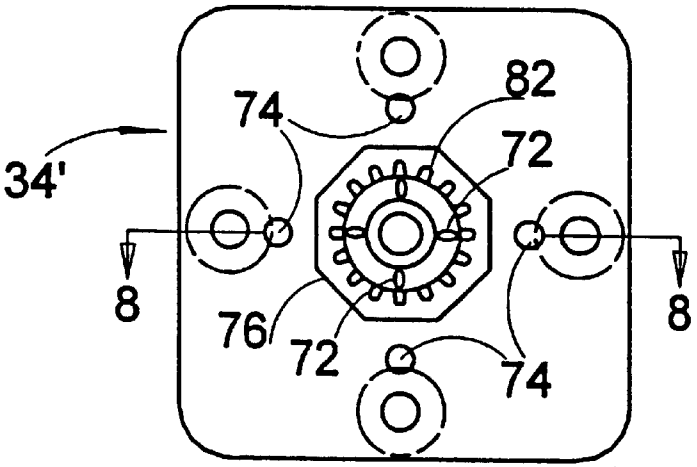
Figure 9

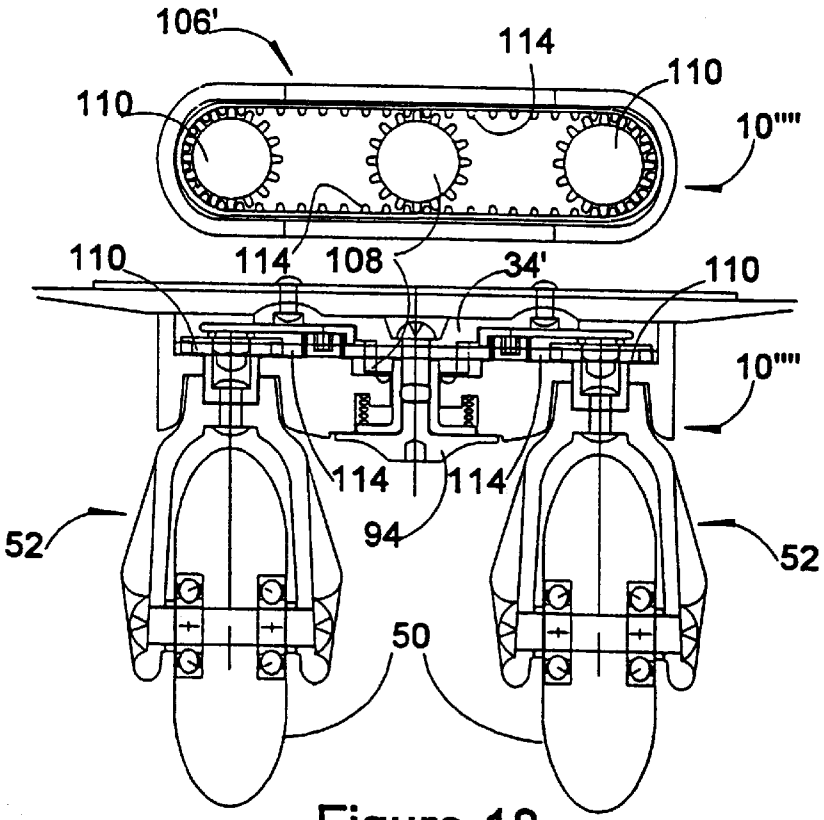
Figure 17
Figure 18
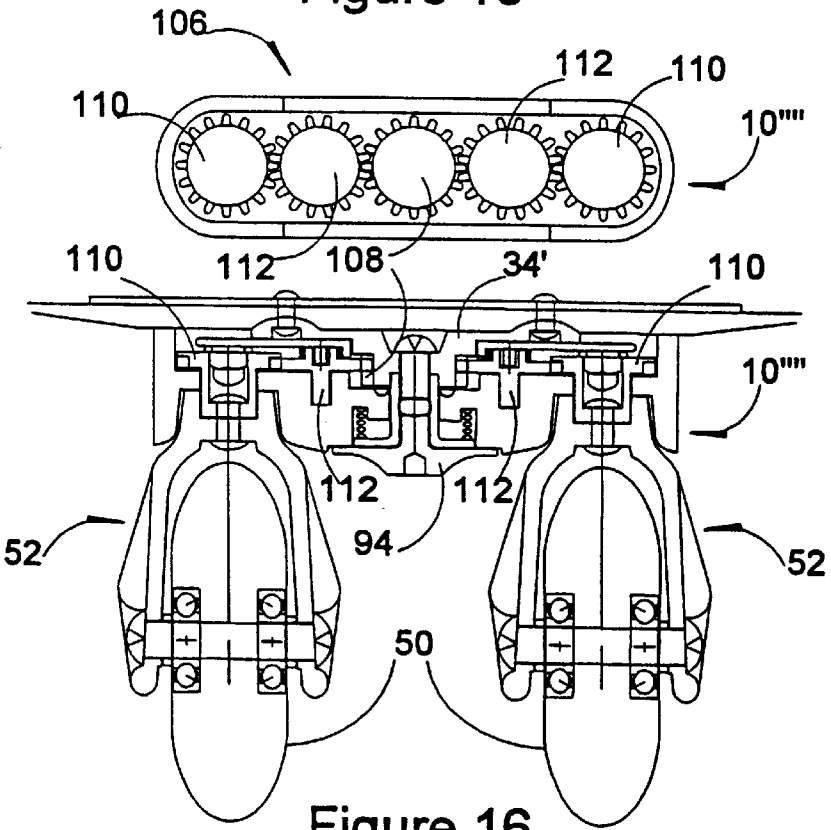
Figure 15
Figure 16

Figure 23
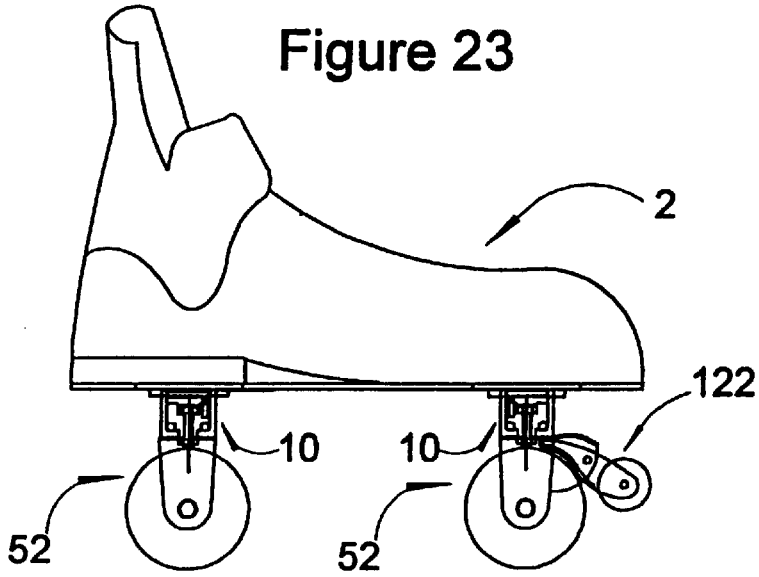
Figure 25
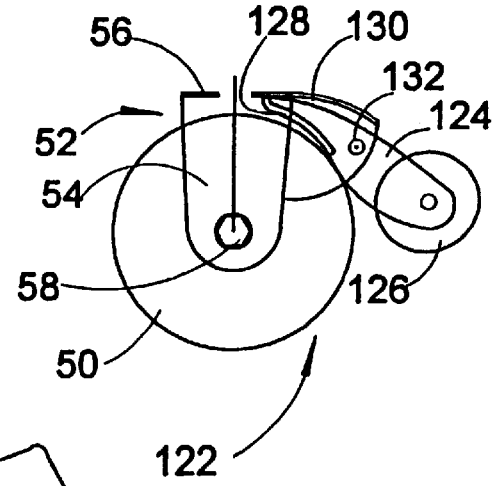
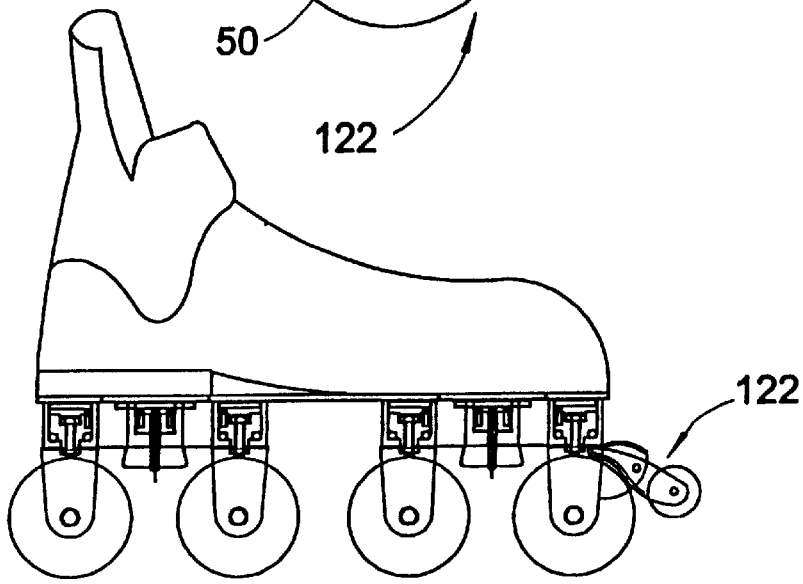
Figure 27

Figure 24
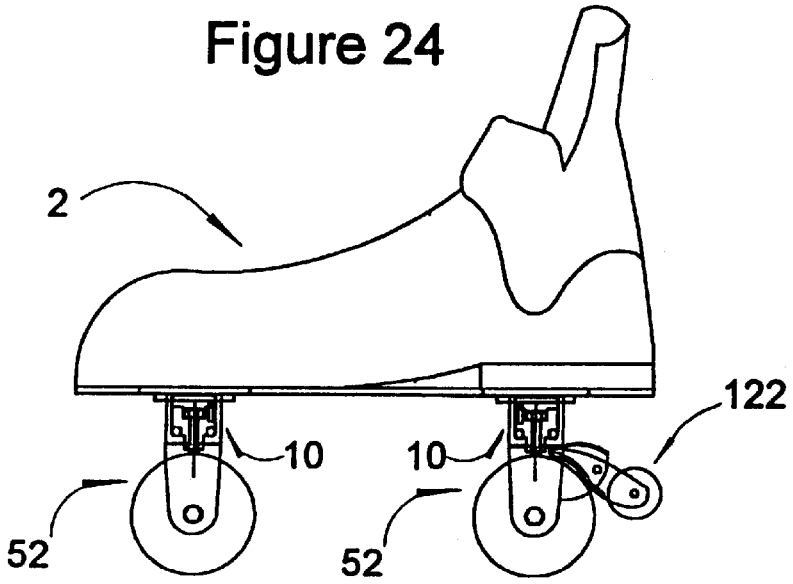
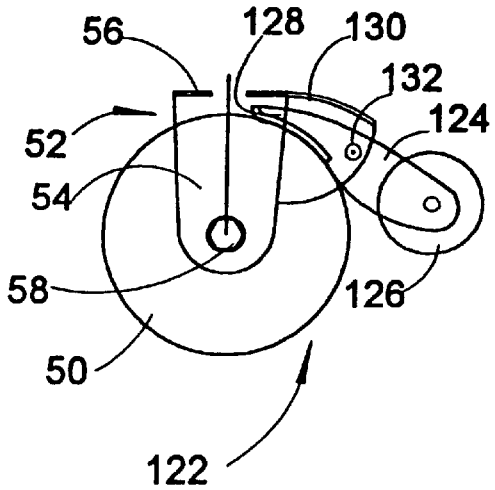
Figure 26
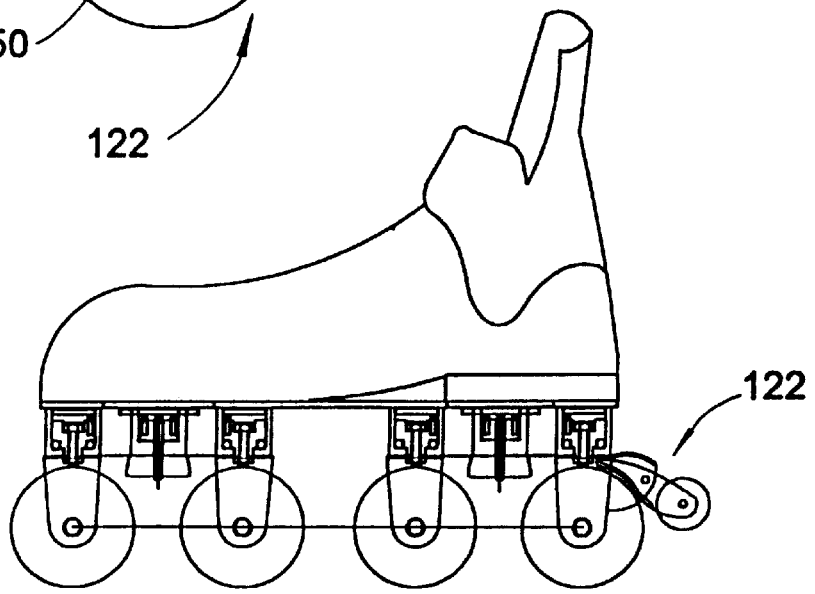
Figure 28

CONVERTIBLE IN-LINE/PARALLEL SKATES

BACKGROUND OE THE INVENTION

1. Field of the Invention

The present invention relates to sporting goods, and particularly to skates. The field of the invention is that of skates having roller wheels.

2. Description of the Related Art

Skates having roller wheels are used for sporting, exercising, and recreational activities. Two varieties of roller skates are well known and used: in-line and parallel skates. These skate designs typically have four roller wheels, either all four in-line so that the planes of the wheels are all coplanar, or parallel in a two by two, or quad, arrangement. The skate also includes a foot or shoe enclosure with a base or chassis which rotatably supports the axles of the roller wheels. The in-line arrangement provides the wearer with the feel of an ice skate, while the parallel arrangement is more stable. Both arrangements are popular, with some activities being more suited for in-line skates, e.g., traveling over outdoor paths, playing field hockey, and other activities for quad or parallel skates, e.g., skating at roller domes, training skaters.

The foot or shoe enclosure portion of the skate is similar for both arrangements. However, the wheel support portions of the skates are typically made from a fixed frame that rotatably supports the axles of the roller wheels. The sharp contrast between the in-line and parallel arrangement requires that the wheel support portions of those skates be dramatically different. Also, the foot or shoe enclosure portion attaches to each type of wheel support arrangement differently. For example, with in-line skates, two elongated plates can serve as journals for all the roller wheel axles. However, it is impractical to provide parallel skates with common journals because of the increased width between the wheels of the parallel skates, although each pair of the parallel wheels may share a common axle. For a skater to utilize both arrangements, one pair of skates for each arrangement must be obtained.

One known convertible skate allows the substitution of a set of in-line roller wheels with a blade for ice skating. This structure actually requires that an assembly of roller wheels be removed and a separate blade assembly be attached to convert the skates. With this design, the same foot enclosure may be used with either arrangement. However, this design requires that the skater carry the spare parts that are removed and replaced. Further, while this design allows for the substitution of a support for in-line roller wheels and a support for an ice skating blade, it does not provide support for a parallel arrangement of roller wheels.

What is needed is a skate which may be readily converted from an in-line arrangement to a parallel arrangement.

SUMMARY OF THE INVENTION

The present invention provides a skate that can be converted from an in-line wheel configuration in which all of the skate wheels are coplanar to a parallel wheel configuration, and vice versa. A pair of yoke chassis positions the wheels relative to the skate. In a simple operation, the wheel configuration may be manually converted using only repositioning of the equipment on the skate itself.

In this invention, the yoke-chassis functions as both the chassis and the connecting mechanism, which also has a predetermined position relative to the post and the wheels, so that the wheels are maintained in parallel to the longitudinal center of the post-base as the yoke-chassis rotates relative to the post. Thus, the connection keeps the wheels always parallel to the length of the foot or shoe enclosure at the predetermined positions.

Both in-line and quad skates are used for sporting and recreational purposes. The traditional quad skate has enjoyed long-standing popularity, while wide-spread commercialization of the in-line skate is relatively recent. The quad skate is particularly suitable for use in places such as roller rinks, while the in-line skate tends to prevail in outdoor use. Generally, the places and uses of the two types of skates are characteristic to each skate. A skater's choice of an in-line or a quad skate then often depends on the type of activity in which the skater wishes to engage. Thus, a skating enthusiast would require more than one pair of skates to fulfill all skating activities in which he might wish to engage. The skater would thus incur the expense of buying more than one pair of skates, and the inconvenience of having to change skates depending on the activity in which the skater desires to engage at a given time.

The present invention utilizes a wheel chassis mounted on posts attached to the bottom of the foot or shoe enclosure. The wheel chassis supports the wheels and is rotatable about the post. A positioning mechanism connects the post to the wheels which are supported by the wheel chassis. The wheel chassis is rotatable between at least two positions, and the connection of the wheels to the post through the positioning mechanism ensures that the angular orientation of the wheels are maintained. One positioning mechanism, namely tie rods, has a predetermined position relative to the post and the wheels so that the wheels are angularly positioned relative to the post. Thus, the tie rods keep the wheels always parallel to the length of the foot or shoe enclosure at the predetermined positions. By rotating the wheel chassis, the wheels may be positioned either in an in-line arrangement, wherein the planes of the wheels are coextensive, and a parallel arrangement, wherein the wheels are parallel and coaxial. Other positioning mechanisms include yokes, gear sets, and externally mounted rods.

By mounting the wheel chassis on the post, many different varieties of foot or shoe enclosures may be utilized with the invention. The posts, in conjunction with the wheel chassis, provide support for the foot or shoe enclosure portion to enhance the rigidity of the foot enclosure and enhance its structural integrity. In one embodiment, two posts are utilized with corresponding wheel chassis and each wheel chassis supports two wheels. This allows for four in-line roller wheels to be employed, which may be readily changed to a two by two parallel arrangement. One method of effecting the change is by loosening a nut which engages the wheel chassis, turning the chassis, and tightening the nut. Another method involves a post with a biasing mechanism for releasing and securing the chassis.

The invention comprises, in one form thereof, a skate with an enclosure, at least two wheels, and a wheel chassis attached to the enclosure and rotatably supporting the wheels, which is characterized by a positioning mechanism. The wheels are oriented by the positioning mechanism in one of at least two arrangements, a first in-line arrangement and a second parallel arrangement The enclosure includes a post extending from a bottom surface of the enclosure, and the wheel chassis is rotatably disposed about the post.

The post includes a threaded portion, and the skate further comprises a nut threadably engaging a threaded portion of the post to rotationally secure the position of the wheel chassis. The post may also include a portion of enlarged diameter supporting a spring which biases the chassis into the post. Another feature of the invention involves an aligning mechanism which orients the chassis relative to the post and may define a plurality of discrete aligned positions for the chassis relative to the post.

One embodiment of the positioning mechanism includes two tie rods connecting the post and the wheels. The tie rods have a predetermined length which maintains the angular position of the wheels relative to the post regardless of the angular position of the chassis. Another embodiment of the positioning mechanism includes gears disposed within the chassis and connecting the post and the wheels. One of the gear based positioning mechanism embodiments includes a belt operably connecting the gears. Still another embodiment of the positioning mechanism includes an elongated member disposed externally of the chassis which connects a wheel of one chassis with a wheel of a second chassis so that the rotation of the two chassis are synchronized. The positioning mechanism provides for the wheels to be maintained in an angular position corresponding to the longitudinal direction of the enclosure throughout the rotation of the chassis.

The invention also provides a brake mechanism attached to one of the wheels for slowing the skate. The wheels are attached to the chassis via wheel supports which include a U-shaped crosspiece journalling an axle which rotatably supports each wheel. The brake mechanism is mounted on a wheel support, and includes a cantilevered arm pivotally attached to the wheel support adjacent the wheel. The cantilevered arm has one end with a friction surface disposed adjacent to the wheel. The other end of the cantilevered arm includes a rotatably mounted roller.

The invention further includes a yoke mechanism removably connected between the post and wheels, and a biasing mechanism for urging engagement of the yoke mechanism with the post and wheels so that by deactivation of the biasing mechanism, the yoke mechanism allows independent positioning of the wheels.

An advantage of the present invention is that a single skate can assume the configuration of either an in-line or a quad skate.

Another advantage is that the present invention can easily and quickly be converted from an in-line to a quad skate and vice versa.

Another advantage is that the present invention can be converted from an in-line to a quad skate and vice versa without removing or adding any equipment.

A further advantage is that the present invention can be used in a variety of locations and under a variety of different conditions calling for skates of different wheel configurations without need for investment in different skates.

A further advantage is that the same wheel and support system of the present invention can be used regardless of the style of the foot or shoe enclosure.

Yet another advantage of the present invention is that the enclosure material surrounding the post is strengthened and the enclosure material thus rigidly supports the wheels and enhances the longevity of the skate.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein:

FIG. 8 is a side sectional view of a second embodiment of the base of the present invention.

FIG. 9 is a top plan view of the base of FIG. 8.

FIG. 10 is a top plan view of a second embodiment of a chassis of the present invention.

FIG. 11 is a side sectional view of the chassis of FIG. 10.

FIG. 15 is a top plan view of a geared embodiment of the positioning mechanism of the present invention.

FIG. 16 is a side sectional view of the embodiment of FIG. 15.

FIG. 17 is a top plan view of a gear and belt embodiment of the positioning mechanism of the present invention.

FIG. 18 is a side sectional view of the embodiment of FIG. 17.

FIG. 23 is a side view of a quad wheel configuration of an embodiment of the present invention having a brake on a front wheel.

FIG. 24 is a side view of a quad wheel configuration of an embodiment of the present invention having a brake on a rear wheel.

FIG. 25 is an enlarged view of a wheel with a brake in a disengaged position.

FIG. 26 is an enlarged view of a wheel with a brake in an engaged position.

FIG. 27 is a side view of an in-line wheel configuration of an embodiment of the present invention having a brake on a front wheel.

FIG. 28 is a side view of an in-line wheel configuration of an embodiment of the present invention having a brake on a rear wheel.

Figure 1:
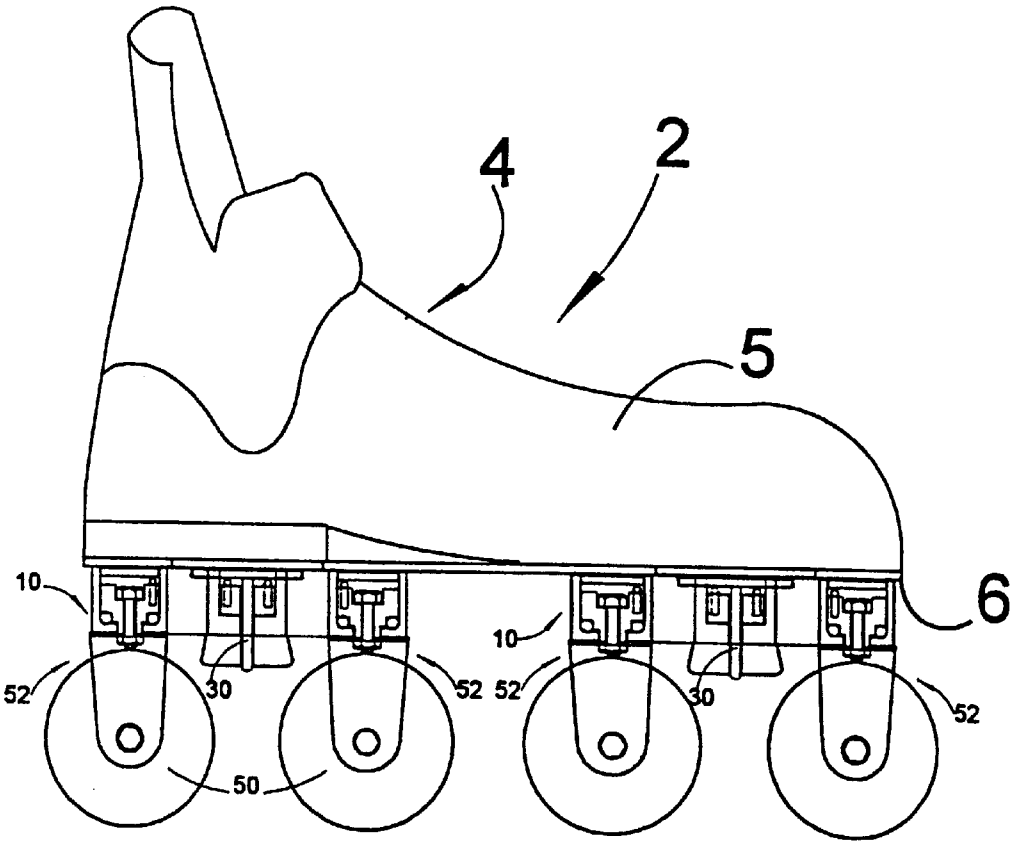
FIG. 1 is a side view of an in-line wheel configuration of an embodiment of the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates preferred embodiments of the invention, in several forms, and such exemplification is not to be construed as limiting the scope of the invention in any manner.

DESCRIPTION OF THE EXEMPLARY EMBODIMENTS

The preferred embodiment disclosed below is not intended to be exhaustive or limit the invention to the precise forms disclosed in the following detailed description. Rather, the embodiments are chosen and described so that others skilled in the art may utilize their teachings.

In accordance with the present invention, skate 2 includes foot enclosure 4, wheel chassis 10, wheel supports 52, and roller wheels 50. Foot enclosure 4 (FIGS. 1 and 2) includes shoe 5 rigidly attached to shoe base 6. Although a foot enclosure is shown, one of ordinary skill would appreciate that a shoe enclosure could also be used with the present invention. On the underside of the enclosure portion of skate 2, wheel supports 52 may be arranged with wheels 50 in either the in-line arrangement of FIG. 1 or the parallel, quad arrangement of FIG. 2. Skate 2 may be readily converted between these arrangements by simple repositioning of the equipment below shoe base 6.

Wheel chassis 10 is rotationally disposed about center post 30 which has threaded portion 32. Center post 30 is rigidly attached to base 34. Center post 30 extends through hole 13 of enclosure or shoe support 11. Shoe support 11 is sandwiched between wheel chassis 10 and shoe base 6 and is rigidly attached to shoe base 6 by attaching wheel chassis 10 to shoe base 6 and post 30. The bottom face of shoe support 11 may have undercut slots that receive and constrain tie rods 18 in a tightened position in either of the in-line or parallel arrangements. Alternatively, the same purpose may be achieved without slots by the bottom face of shoe support 11 being comprised of a resilient material which constrains tie rods 18. Nut 36 is adjustably threaded onto threaded portion 32 to hold wheel chassis 10 against base 34.

Wheel chassis 10 also includes inserts 12 rotatably disposed in an opening of chassis 10. Inserts 12 function as a collar and allow wheel support 52 to rotate relative to wheel chassis 10. Preferably, inserts 12 have a major diameter in the range of 7.5 mm to 44.5 mm. O-rings 19 may be optionally disposed between inserts 12 and chassis 10 to provide resilient dampening to the micro-movement of insert 12. Rod 20 is rigidly attached to insert 12, and to wheels 50 as described below. Inserts 12 include holes 14 which removably receive tie rods 18 which rotatably position inserts 12 relative to chassis 10. Holes 14 are located at a predetermined diameter, preferably about 2–5 mm away from the major diameter, outer perimeter, of insert 12, so that the relative rotation of inserts 12 and wheel chassis 10 is maintained such that whenever wheel chassis 10 is rotated by 90°, wheels 50 automatically follow the rotation to keep parallel to the length of enclosure 4.

Tie rods 18 functionally connect post 30 and wheel supports 52, and are of precision length to conform to predetermined engineered positions of the skate and wheel chassis. The connection of tie rods 18 with post 30 and wheel supports 52 serves as a positioning mechanism which provides for the automatic positioning of wheels 50. The preferred length of tie rod 18 equals the length of the distance between the axial center of post 30 and the axial center of insert 12, plus the diameter of tie rod 18. The center of holes 14 are preferably disposed at a 45° angle from the axial center of its insert 12 relative to a reference line extending through the center of both inserts 12 when they are disposed in wheel chassis 10. Also, holes 15 in collar 70, as described in greater detail below, are located at a predetermined diameter from the axial center of collar 70, preferably about 2–5 mm away from the major diameter of collar 70, and are also disposed at a 45° angle from the axial center of collar 70 relative to the same reference line.

Wheel supports 52 include crosspieces 56 rigidly attached to rod 20 by nut 22. Alternatively, rod 20 may be connected to wheel supports 52 by a rivet or other suitable attachment. Arms 54 are rigidly attached to crosspiece 56 to form a U-shaped supporting piece. Axle 58 is journalled between arms 54. Wheel 50 rotates about axle 58 and is secured to axle 58 by nut 60. Alternatively, wheel 50 may be connected to axle 58 by a rivet or other suitable attachment. With rod 20 rigidly attached to both insert 12 and wheel support 52, the pivotal movement of insert 12 within wheel chassis 10 causes the angular position of wheel 50 to change relative to wheel chassis 10. However, the structure and arrangement of tie rods 18 ensure that the angular position of wheel 50 relative to enclosure 4 remains substantially constant.

Figure 5:
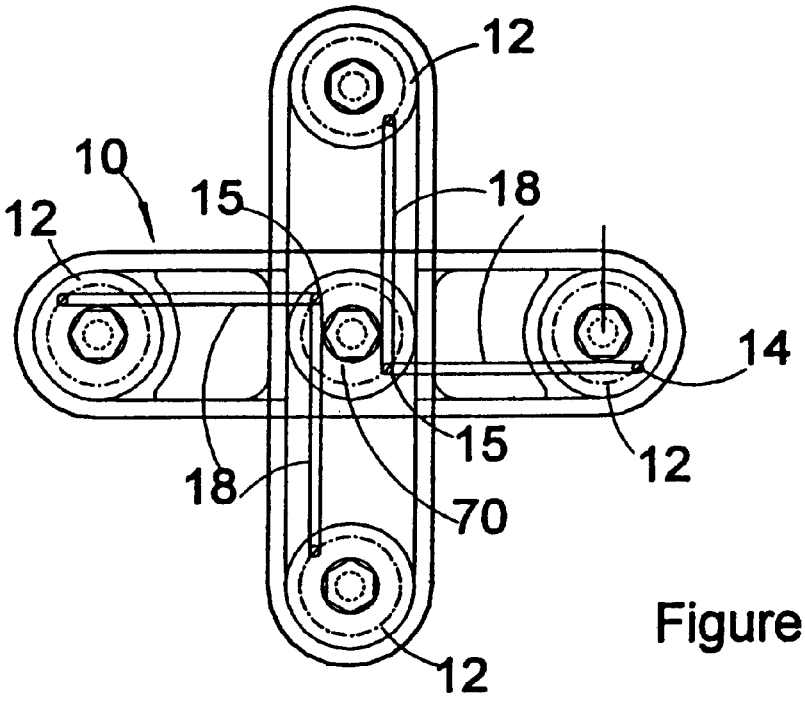
FIG. 5 is a top view of two rotational configurations of the wheel assemblies shown in FIGS. 3 and 4.
Figure 6:
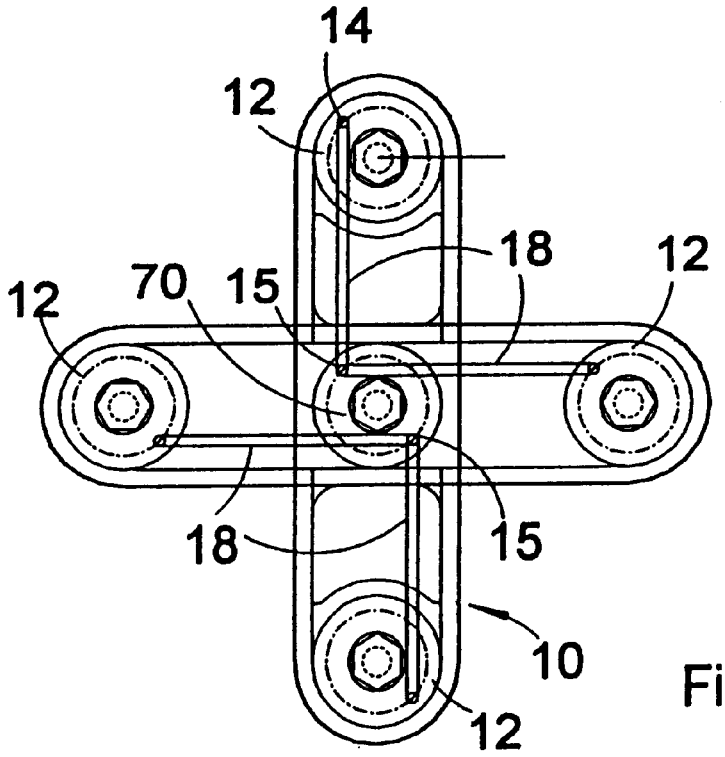
FIG. 6 is another top view of two other rotational configurations of the wheel assemblies shown in FIGS. 3 and 4.
Figure 7:
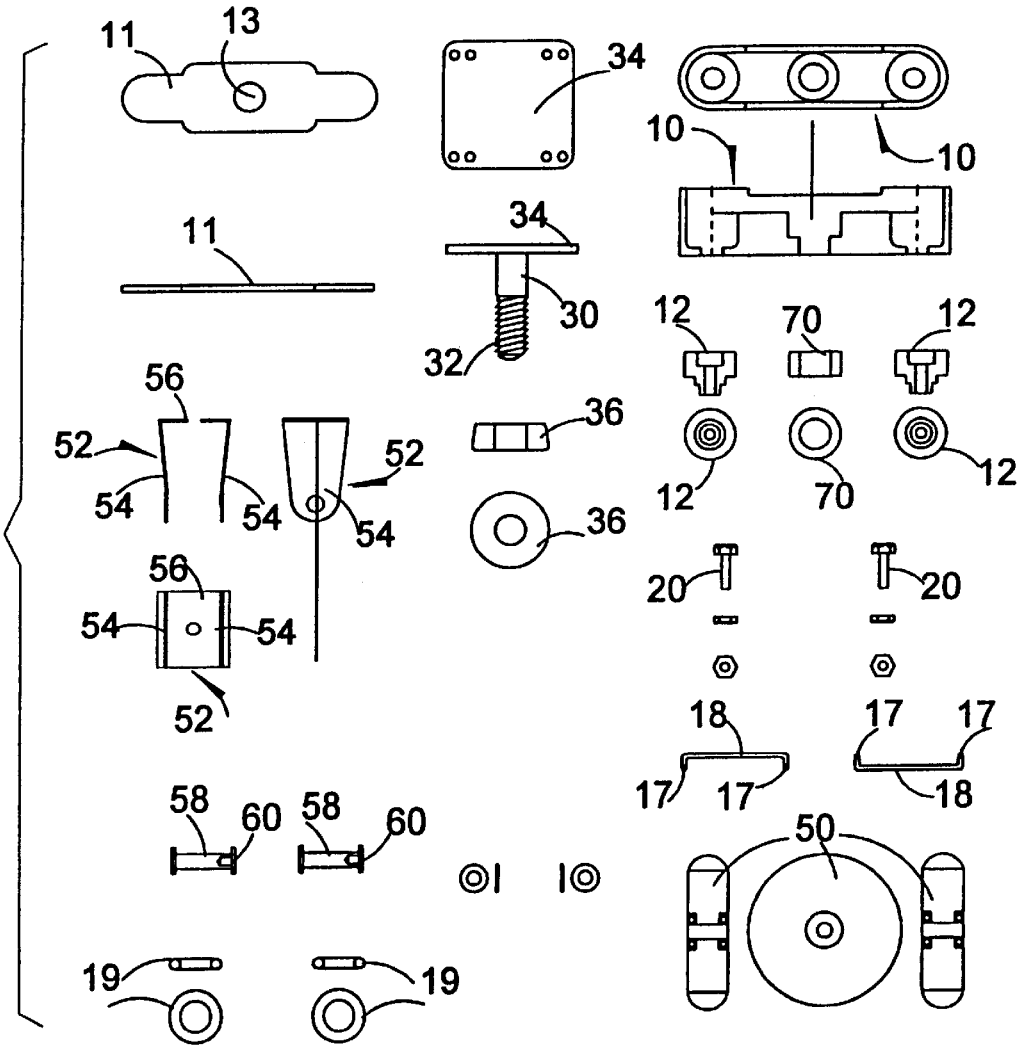
FIG. 7 is an exploded view of various component parts of the embodiment shown in the preceding Figures.
Figure 13:
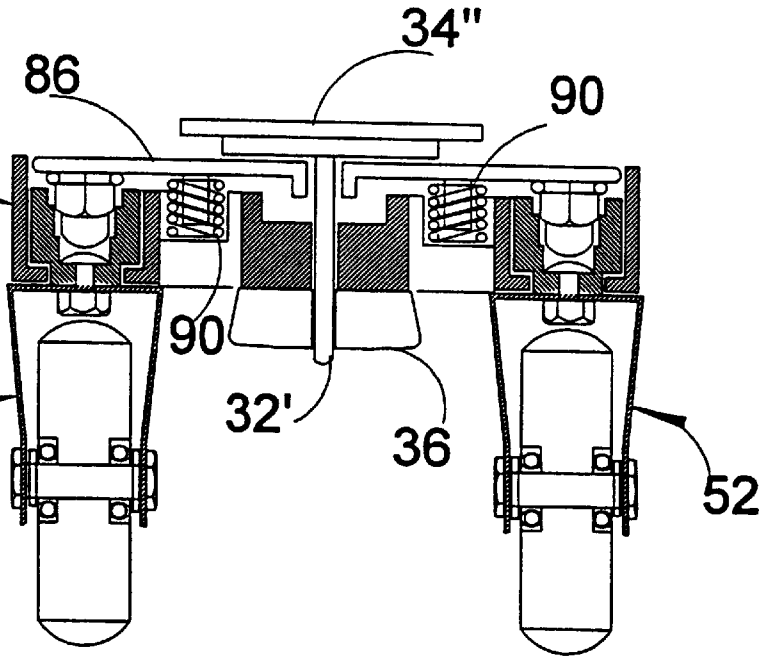
FIG. 13 is a side sectional view of a second embodiment of a yoke and spring adjustment mechanism of the present invention.
Figure 12:
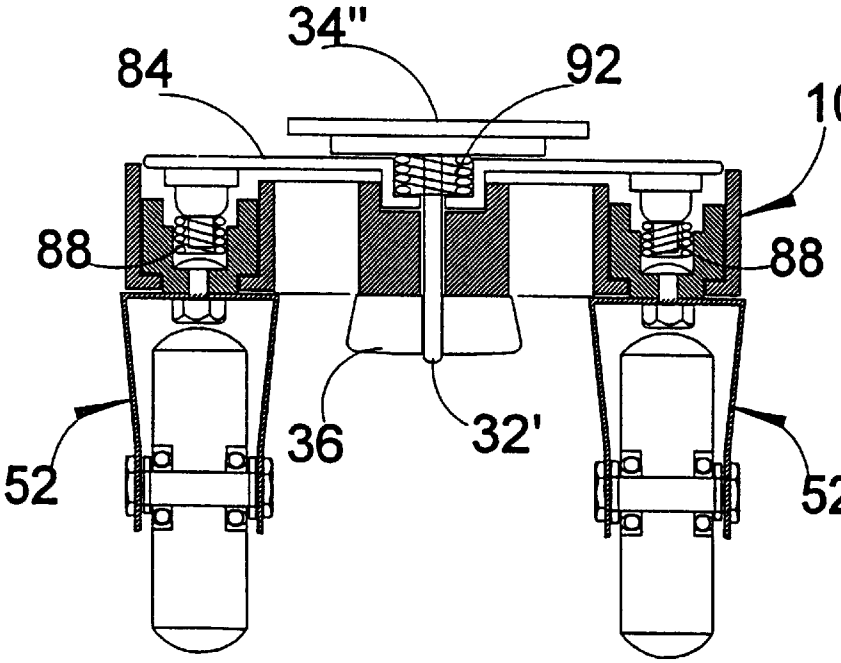
FIG. 12 is a side sectional view of a first embodiment of a yoke and spring adjustment mechanism of the present invention.

To arrange skate 2 in a particular wheel configuration, nut 36 is loosened and wheel chassis 10 is rotated about post 32 to the desired position. The rotation of the wheel support 52 and wheel chassis 10 together causes the skate to assume the configuration of either a quad or in-line skate. As shown in FIGS. 5 and 6, finger 17 at one end of tie rod 18 is pivotally inserted into holes 15 of collar 70, and collar 70 is fixed to center post 30. Finger 17 at the other end of tie rod 18 is pivotally inserted into hole 14 of insert 12. Tie rod 18 is prevented from escaping this position because of the small clearance available when nut 36 attaches chassis 10 to base 34, and because of the constraint by shoe support 11 when nut 36 is tightened. As shown in FIGS. 5 and 6, rotation of wheel chassis 10 pivots tie rod 18 about collar 70, changing the configuration of wheels 50 from an in-line to a parallel or quad position and vice versa.

To obtain the in-line skate wheel configuration shown in FIG. 1, nut 36 is loosened, and wheel chassis 10 is rotated to a position parallel to shoe base 6. As wheel chassis 10 is rotated, tie rod 18 pivots about collar 70, contemporaneously pivoting wheels 50 to a position parallel to shoe base 6. Nut 36 is then tightened on threaded post 32 to maintain wheel chassis 10 in a position parallel to shoe base 6. Optionally, wheel chassis 10 may include a notch or other structure to engage base 34 in this position when nut 36 is sufficiently tightened.

Figure 2:
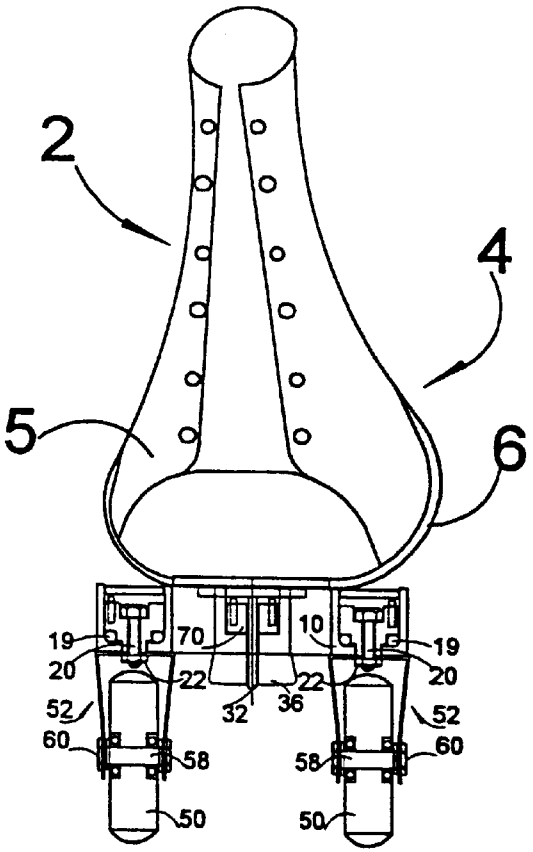
FIG. 2 is a front view, showing both pairs of wheels, of a parallel wheel configuration of an embodiment of the present invention.
Figure 4:
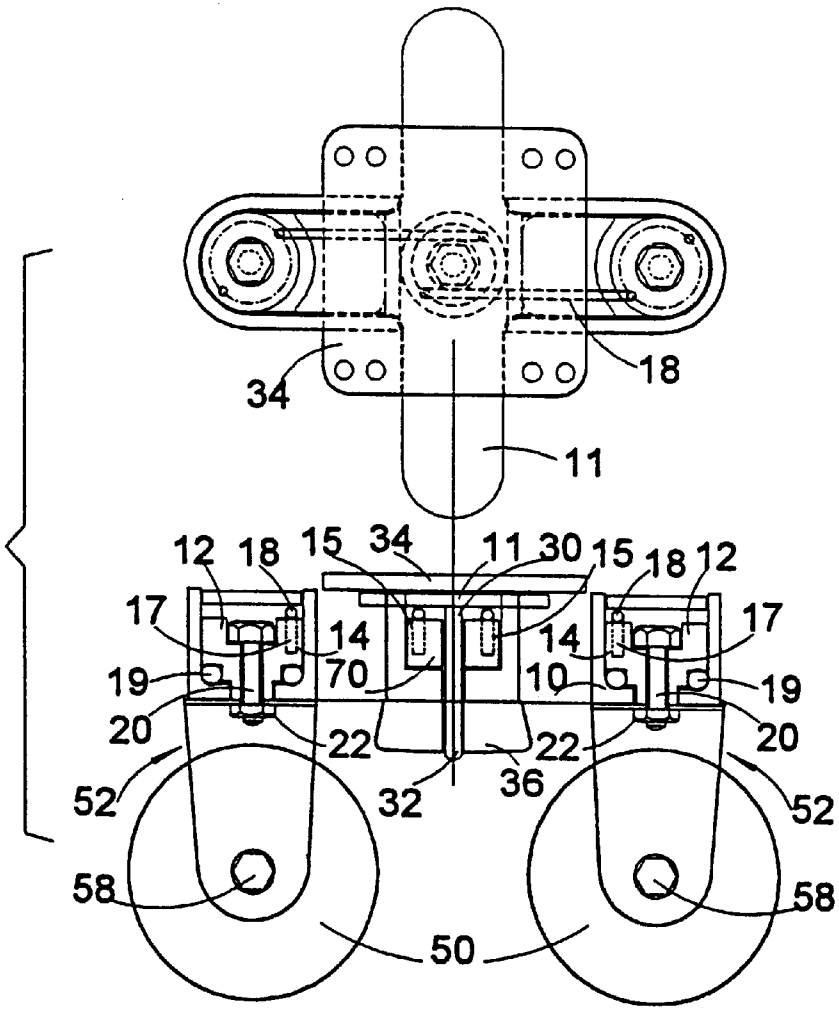
FIG. 4 is a side view of the wheel assembly of FIG. 1.
Figure 3:
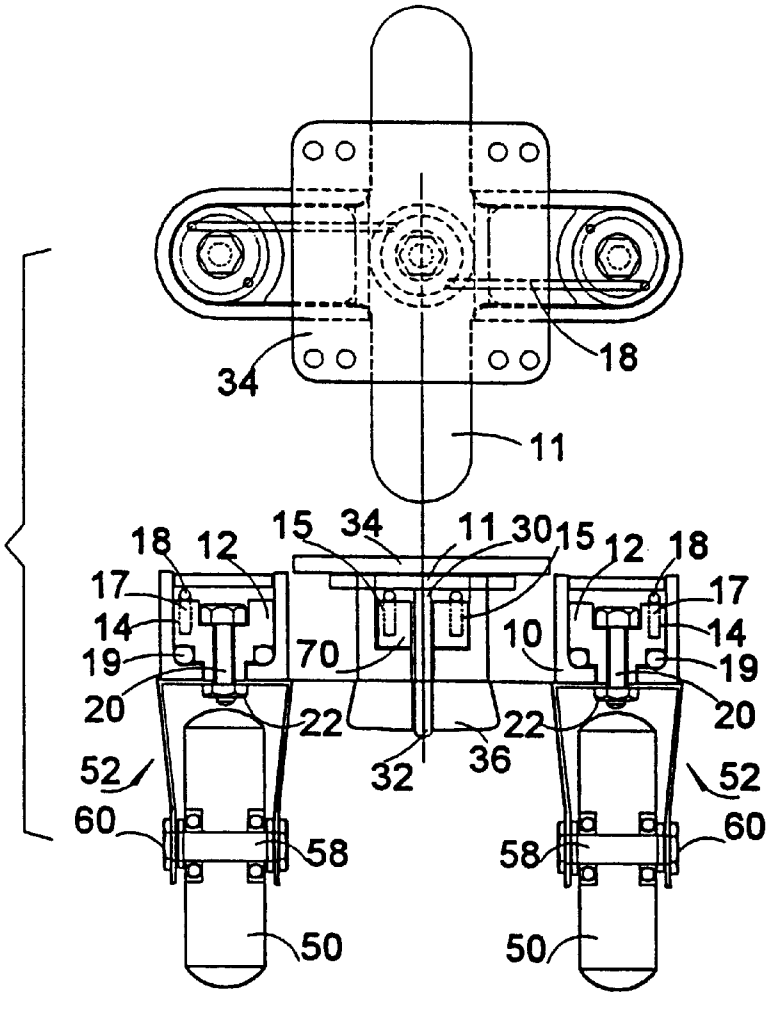
FIG. 3 is a front view of the wheel assembly of FIG. 2.

To obtain the quad skate wheel configuration shown in FIG. 2, nut 36 is loosened, and wheel chassis 10 is rotated to a position perpendicular to shoe base 6. As wheel chassis 10 is rotated, tie rod 18 pivots about collar 70, contemporaneously pivoting wheels 50 to a position parallel to shoe base 6. Nut 36 is then tightened on threaded post 32 to maintain wheel chassis 10 in a position perpendicular to shoe base 6. Optionally, wheel chassis 10 may include a notch or other structure to engage base 34 in this position when nut 36 is sufficiently tightened.

The embodiment of the present invention shown in the drawings includes four wheels; FIG. 1 shows the four wheels in one line, while FIG. 2 shows the wheels at the four corners of a square or rectangle. Alternatively, a skate defined by the present invention could have virtually any configuration of skate wheels, for example combinations of 2×1 parallel and 1×2 in-line, or 2×3 parallel and 1×6 in-line, or even combinations of odd numbers of wheels for each foot, such as 1+2×1 parallel and 1×3 in-line wheel configurations.

The embodiment of the present invention shown in FIGS. 1 and 2 show an enclosure with closed geometry, such as a shoe, with fixed dimensions. In fact, the enclosure of the skate may have either closed geometry as in a shoe, the enclosure may have open geometry as in a sandal, or the enclosure may be structured and arranged to attach to a shoe or boot. In addition, the enclosure may have either fixed or adjustable dimensions.

Several variations of the present invention are shown in the remaining FIGS. 8–28 and described in greater detail below.

FIGS. 8–11 show several structural modifications to base 34' which align chassis 10'. These aligning features; matching tabs 72 and slots 73 (depicted as equally spaced groups of six), pins 74 and holes 75 (depicted equally spaced groups of four), polygonal projection 76 and indentation 78 (depicted as octagonal), or similar features; constrain the rotational movement of chassis 10' relative to base 34'. Although tabs 72 and projection 76 are shown as part of base 34', and pins 74 and projection 76 as part of chassis 10', one recognizes these matching features may be alternatively be constructed in chassis 10' and base 34', respectively. Also each of the total number of the male portion of the aligning or matching features 72, 74, and 76 each may be less than the total number of their corresponding female matching features 73, 75, and 78. In order for chassis 10' and base 34' to rotate 90° relative to one another, at least two of the female aligning features must be spaced at a 90° angle, which can be achieved by equally spacing an even or choice number of male aligning features. With more than two such female features, the matching male aligning features may temporarily rest in an intermediate orientation and prevent random wheel orientation. Chassis 10' also includes edges 80 which engage the periphery of base 34' in the in-line and quad configuration. Base 34' includes gear teeth 82 for engagement with further embodiments of the positioning mechanism of the present invention which are set forth in greater detail below.

Another variation of the present invention involves a yoke mechanism which allows individual adjustment of the wheel orientation. Yokes 84 and 86 are mounted on posts 32' within chassis 10" and 10" of FIGS. 12 and 13, respectively. The upper surface of yokes 84 and 86 may have aligning features as disclosed in FIGS. 8–11 above to position the wheels. Similar aligning features may be incorporated between the chassis and each wheel support to individually align the wheels. Springs 88 and 90 are disposed between the yokes and the chassis, or alternatively spring 92 may be disposed between the chassis and base 34". When nut 36 is loosened, the resilient biasing of the springs separates the yokes from the chassis so that each wheel may be independently aligned in a parallel or in-line arrangement.

Figure 14:
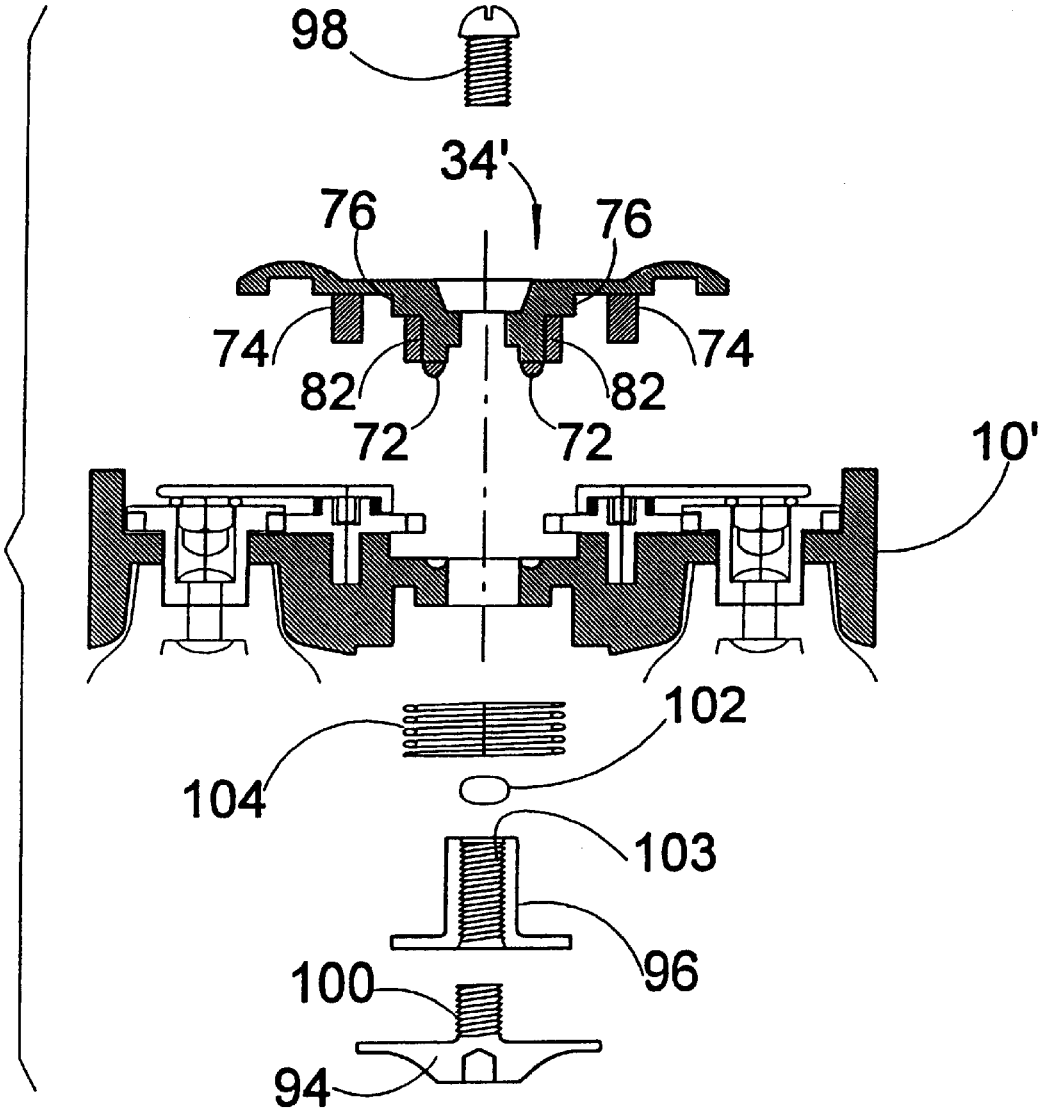
FIG. 14 is an exploded view of the components of another embodiment of the present invention.

As an alternative to nut 36 being tightened on post 32, a modified center post may resiliently connect the chassis to the base, as shown in FIG. 14. In this embodiment, the center post comprises support plate 94, sleeve 96, and connector 98. Connector 98 extends through base 34' to connect with support plate 94. In the disclosed embodiment, connector 98 has external threads which matingly engage internal threads 103 of sleeve 96 which is also in threaded engagement with connecting portion 100 of support plate 94. The connection via sleeve 96 may be facilitated by resilient insert 102 disposed within sleeve 96 between connector 98 and connecting portion 100. Spring 104 is disposed around sleeve 96 with one end adjacent to the enlarged diameter portion of post support plate 94 and sleeve 96, and the other end of spring 104 is adjacent to chassis 10'. Under typical operating conditions, spring 104 biases chassis 10' into base 34'. For rotation or reorientation of wheel supports 52, chassis 10' may be pulled down against the force of spring 104 and out of engagement with base 34' so that chassis 10' may be repositioned in either the in-line or parallel arrangement. Once the repositioning is achieved, spring 104 biases chassis 10' back into engagement with base 34'.

Alternative embodiments of the positioning mechanism of the present invention using gears are shown in FIGS. 15–18. FIG. 15 shows chassis 10"" housing gear set 106. Gear set 106 includes post gear 108 fixedly connected to post 94 and base 34', and wheel gears 110 connected with wheel supports 52. Rotation from post gear 108 is transferred to wheel gears 110 through intermediary gears 112 which are mounted in chassis 10"". The contacts between gears 108, 110, and 112 synchronize the orientation of wheel supports 52 when chassis 10""is rotated about post 94. While intermediary gears 112 are not essential for the functioning of the positioning mechanism, their inclusion allows for all of the gears to have a smaller size.

The embodiment of FIGS. 17 and 18 is similar to the embodiment of FIGS. 15 and 16 described above, except for the substitution of toothed belt 114 as the motion transfer mechanism of gear set 106'. Toothed belt 114 is disposed within chassis 10"" and engages post gear 108 and wheel gears 110. Similar to the embodiment of FIGS. 15 and 16, rotation of chassis 10"" causes toothed belt 114 to move and rotate wheel gears 110 in synchronized fashion.

Figures 19, 20, 21, 22:
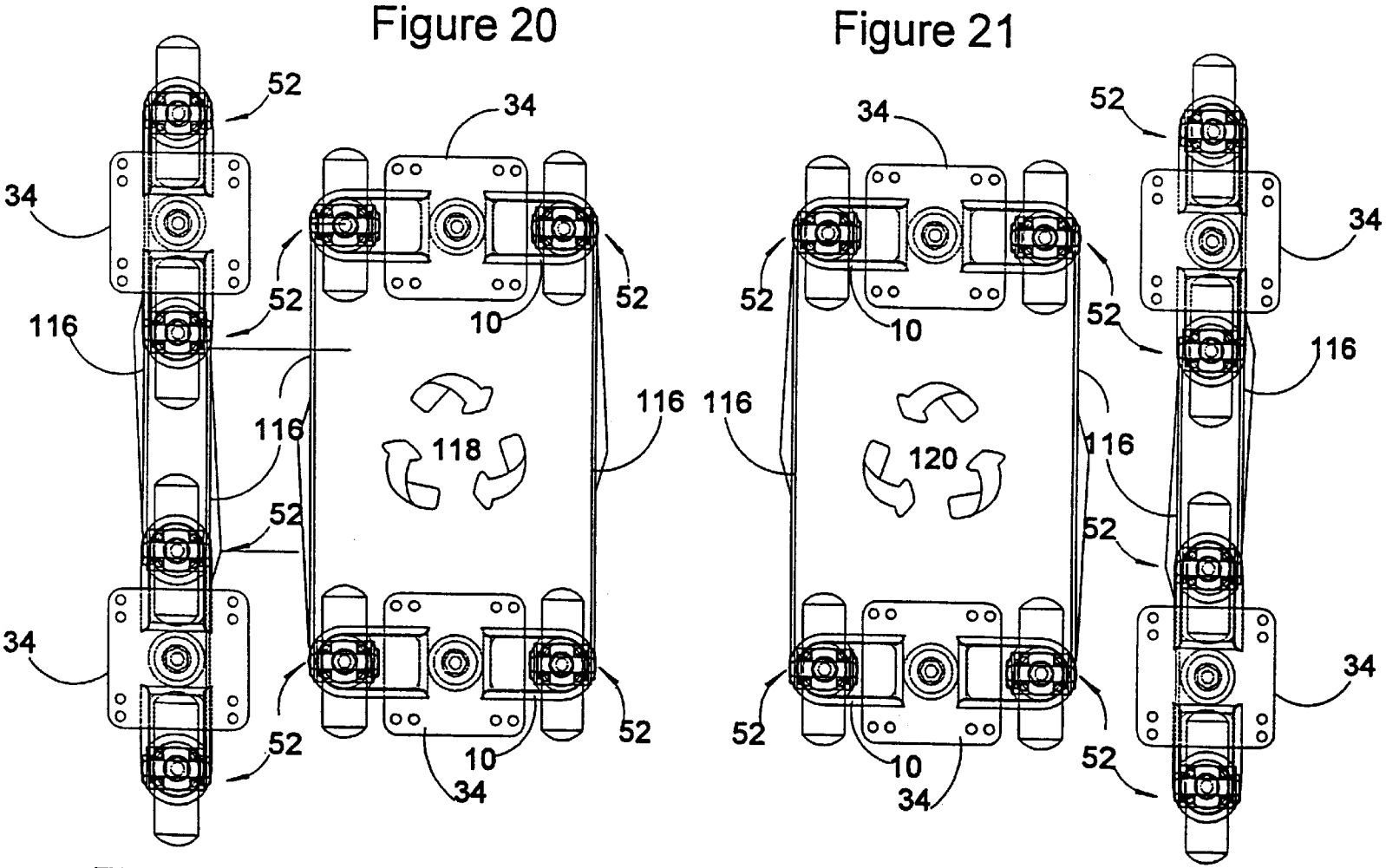
FIG. 19 is a top plan view of an embodiment of the present invention having an external positioning mechanism in a first position.
FIG. 20 is a top plan view of an embodiment of the present invention having an external positioning mechanism in a second position.
FIG. 21 is a top plan view of an embodiment of the present invention having an external positioning mechanism in a third position.
FIG. 22 is a top plan view of an embodiment of the present invention having an external positioning mechanism in a fourth position.

Another embodiment of the present invention, wherein the positioning mechanism is located externally of the chassis, is shown in FIGS. 19–22. An elongate member such as rods or panels 116 are attached to specific locations on the periphery of wheel supports 52 so that the entire assembly of chassis 10 and rods 116 moves together when one of chassis 10 is rotated relative to its base 34. In the exemplary embodiment rods 116 are disposed perpendicularly to the axis of axle 58. As indicated by arrows 118, the parallel or quad arrangement of FIG. 20 is transformed into the in-line arrangement of FIG. 19 by the clockwise rotation of chassis 10. Similarly, arrows 120 of FIG. 21 illustrate how the counterclockwise rotation of chassis 10 transforms a parallel or quad arrangement into an in-line arrangement such as shown in FIG. 22. Thus, rods 116 each connect two wheel supports 52 on the same side of the skate, and maintain the same distance and longitudinal orientation throughout the rotation of chassis 10.

The present invention also includes brake 122 as shown in FIGS. 23–28. Brake 122 comprises cantilevered arm 124 having roller 126 at one end and friction surface 128 at the other end. Support plate 130 is fixed to, or integrally formed with, wheel support 52 and supports pivot 132 about which cantilevered arm 124 moves. Brake 122 may be attached to one of a front or rear wheel 50, or both, and adjacent the toe or heel region of skate 2, such that in an in-line arrangement the wheel 50 having brake 122 must be either the first or last wheel. In the quad or parallel arrangement, brake 122 is simply on the side of the pair of front or rear wheels.

The braking action is activated by the skater inclining skate 2 so that roller 126 contacts the surface over which skate 2 is traversing. The contact of roller 126 pivots arm 124 so that friction surface 128 compresses wheel 50. The friction between friction surface 120 and wheel 50 slows the rotation of wheel 50, thus applying braking action. In the in-line arrangement, the braked wheel is the only wheel rotating on the skating surface, while in the quad or parallel arrangement another wheel may also be rotating on the skating surface. Unlike conventional skate brakes which create friction directly with the skating surface, the friction surface of the present invention does not contact the skating surface, thus greatly reducing wear on the brake. In addition, the brake of the present invention still allows the user to skate while breaking, providing the skater with greater control of the skating and braking manoeuver.

Further alternative embodiments of the present invention are shown in the additional drawing FIGS. 29–48 and further described in detail in the following. These embodiments utilize a pair of yoke-chassis to accomplish the configuration changing function for the wheels of the skate.

Figure 29:
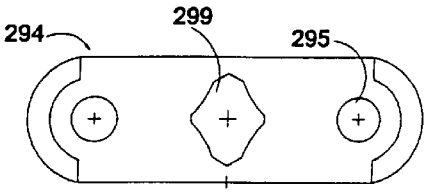
FIG. 29 is a top view of an anchor the present invention.
Figure 30:
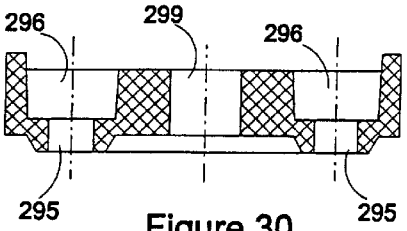
FIG. 30 is a section profile view of FIG. 29 of the present invention.
Figure 31:
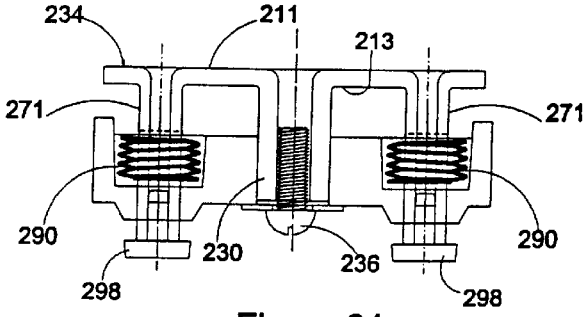
FIG. 31 is a section view of an assembly showing the anchor engaged with the post-base, the fastener and the spring mechanism of the present invention.

FIGS. 29–31 show anchor 294 relating to the following further embodiments of the present invention. Anchor 294 provides a connection between the attachments to the shoe portion of a skate to yoke-chassis 210. In FIGS. 29–30 each of the receptacles on either side of anchor 294 are shown to have opening 295 for receiving fixed member 271 and enlarged spaces 296 within the same opening for receiving spring mechanism 290. FIG. 31 shows a section profile of anchor 294 engaged with post-base 234 which engages anchor 294 using post 230, fastener 236, fixed members 271 and receptacles 296.

Figure 32:
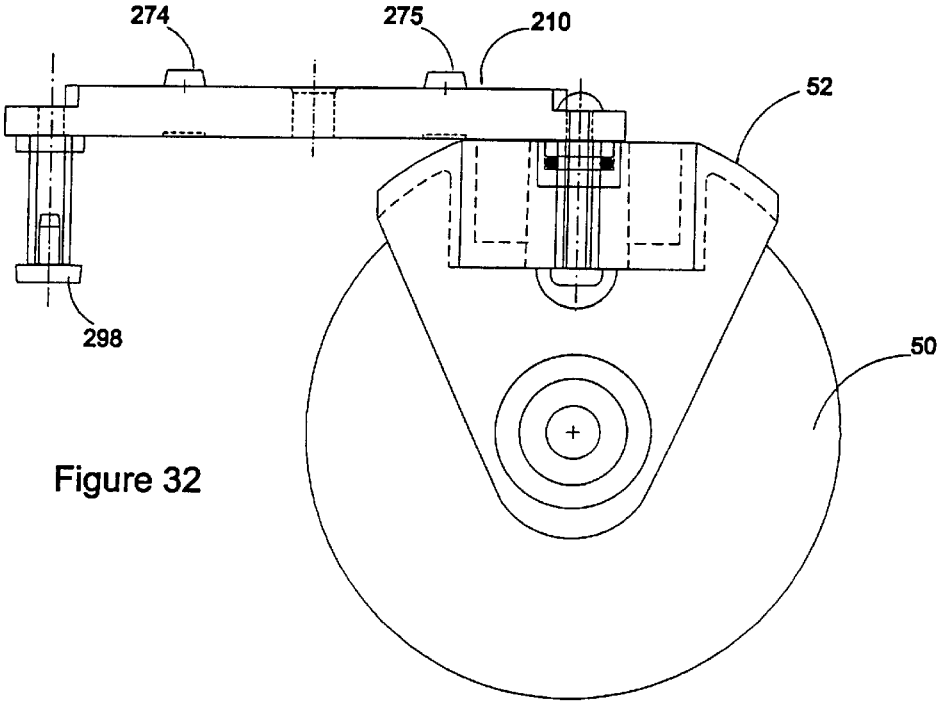
FIG. 32 is a side view of the wheel support assembly and the yoke-chassis and its alignment means.

Fixed members 271 receive yoke-chassis 210 to position wheels 50. FIG. 32 shows wheel 50, wheel support 52, yoke-chassis 210 and related alignment lugs 274 and 275. Further details of the yoke-chassis and the wheel support are illustrated in FIGS. 44–48. This arrangement allows the alternative positions of wheels 50 depicted in FIGS. 33 and 34.

Figure 33:
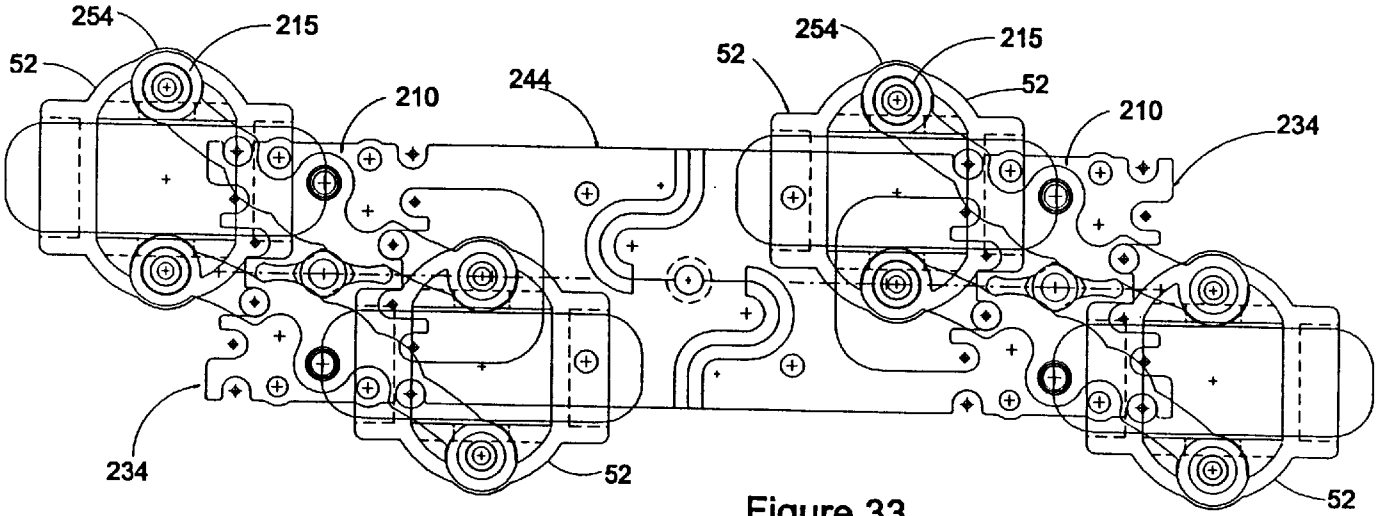
FIG. 33 is a top view of a parallel rotational configuration of the present invention.
Figure 34:
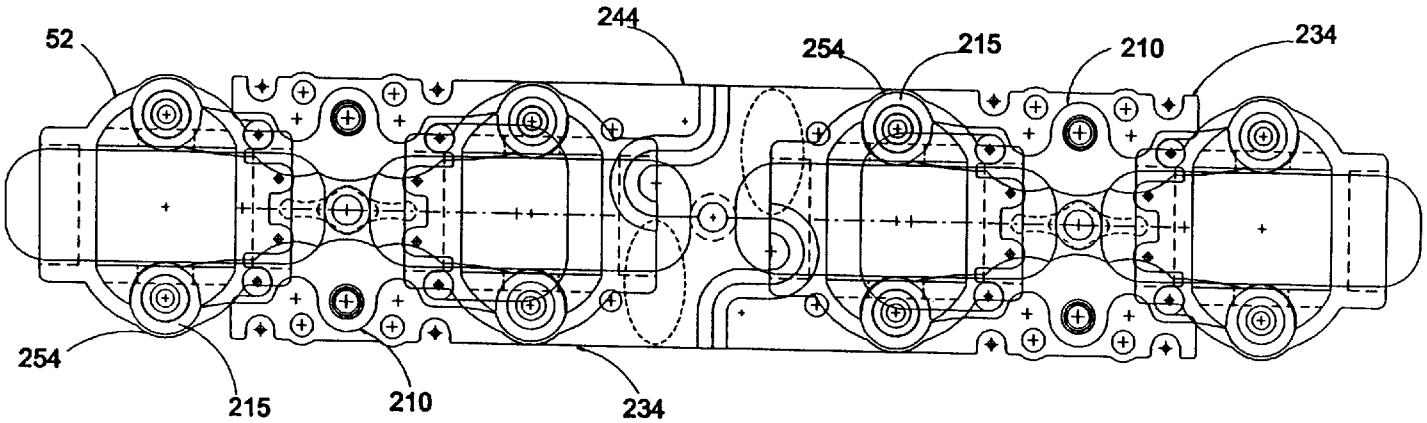
FIG. 34 is another top view showing an in-line configuration of the present invention.

FIG. 33 shows the skate in a parallel arrangement, while FIG. 34 shows the skate in an in-line arrangement. It is understood that the four wheels in FIG. 33 could be easily rearranged to take on an arrangement resembles that of a trapezoid while the two wheels on each side of the longitudinal center line remains parallel to the longitudinal center line. Both FIGS. 33 and 34 also show integrated post-base 244 which has a structure formed by combining two post-bases 234 of FIG. 31. Each wheel support 52 has dual pivotal provisions 254 for a rotatable connection to their respective ends 215 of yoke-chassis 210.

Figure 35:
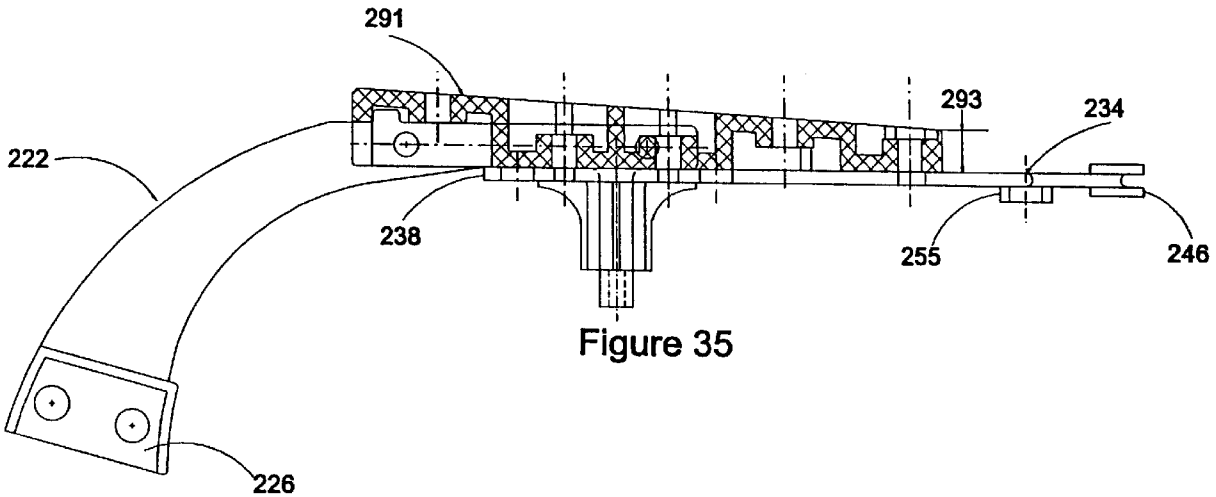
FIG. 35 is an assembled side view of brake mounting means and heel spacer plus the post-base.
Figure 36:
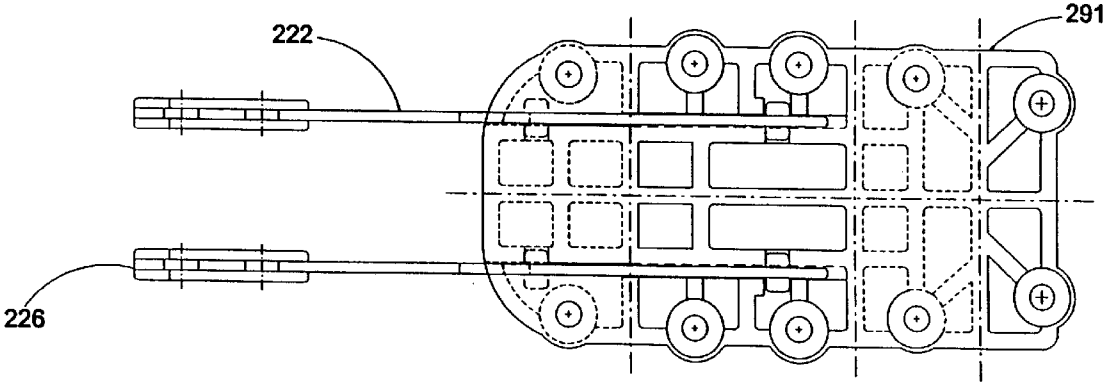
FIG. 36 is a top view of the assembly in FIG. 35 of the present invention.
Figure 37:
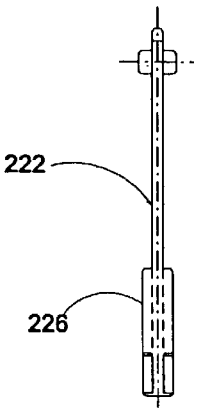
FIG. 37 is a rear plan view of the brake mounting mechanism of FIG. 35.
Figure 38:
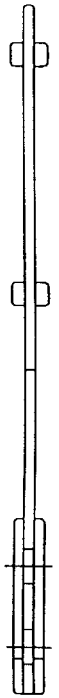
FIG. 38 is a top plan view of FIG. 37.
Figure 39:
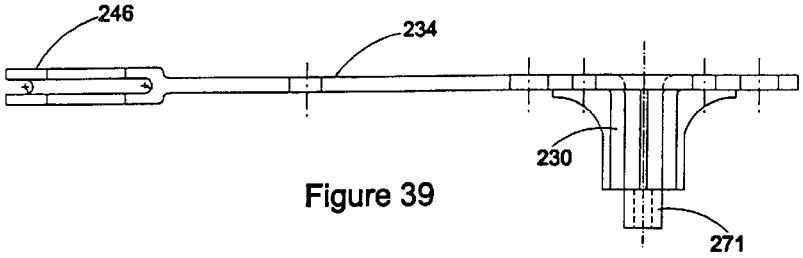
FIG. 39 is a side view of the post-base showing the joining feature and the post from one side.
Figure 40:
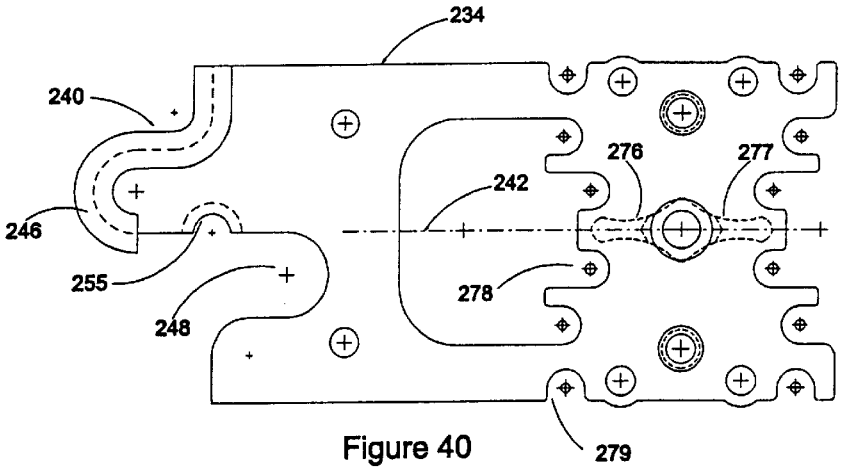
FIG. 40 is a top view of the post-base showing alignment and antirotation means.
Figure 42:
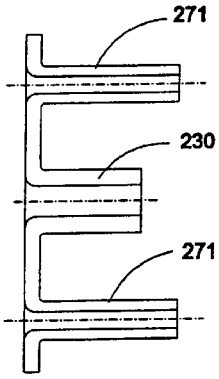
FIG. 42 is a side view of the post-base showing the fixed members and the post.
Figure 41:
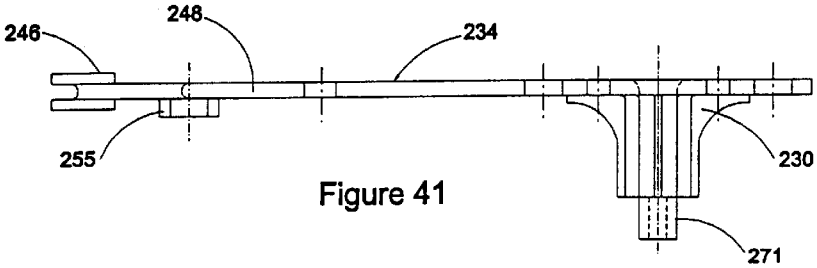
FIG. 41 is a side view of the post-base showing the joining feature and the post from another side.

FIGS. 35–37 relate to brake mounting bracket 222 and heal spacer 291. In FIG. 35, brake mounting bracket 222 is attached to heel spacer 291 and is sandwiched between post-base 234 and heel spacer 291. Bracket 222 extends beyond rear boundary 238 of post-base 234. The height of heel spacer 291 provides gap 293 accommodating the conventional amount of a cushion material. FIG. 36 shows the top plan view showing the attachment of brake mounting bracket 222 to heel spacer 291. FIG. 37 shows a rear view of brake mounting bracket 222, wherein its lower portion is attached to brake support section 226, which is capable of mounting a conventional brake pad (not shown).

FIGS. 39–42 presents the unique post-base design which includes the following: post 230, two fixed members 271 proximate the post, joining portion 240 with male protrusion 246 and female recess 248, retaining apertures 276, 277, alignment apertures 278, 279, and a locking hole 255 for mechanically locking two post-bases 234 together.

Figure 43:
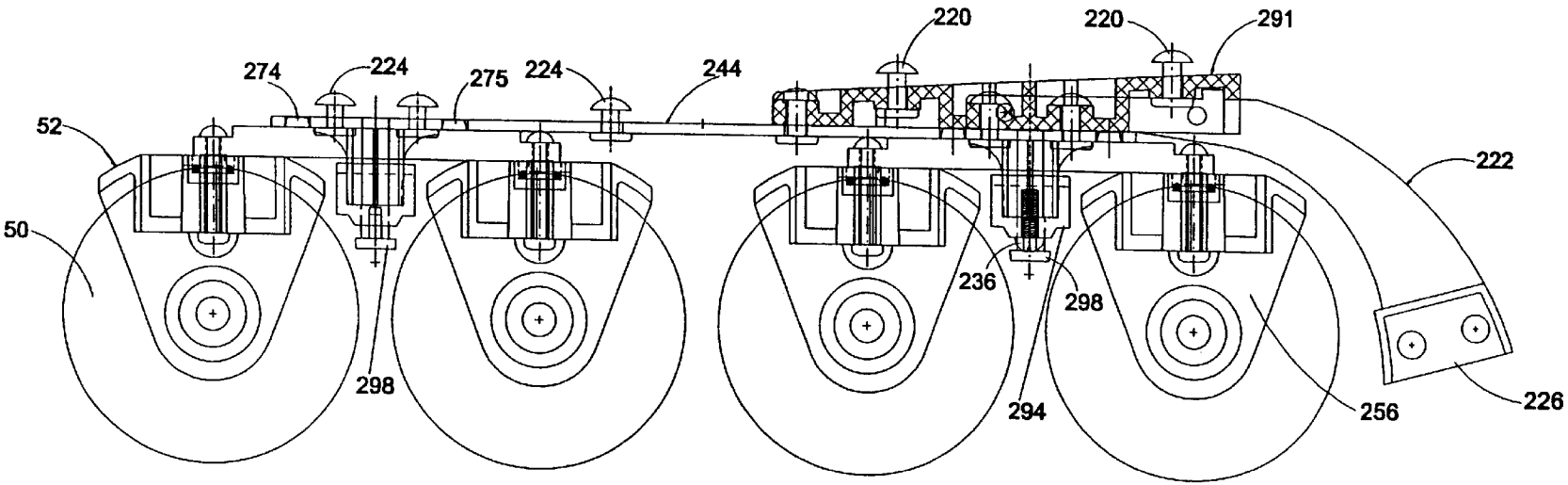
FIG. 43 is a side view combining all the various components of the present invention in one assembly.
Figure 44:
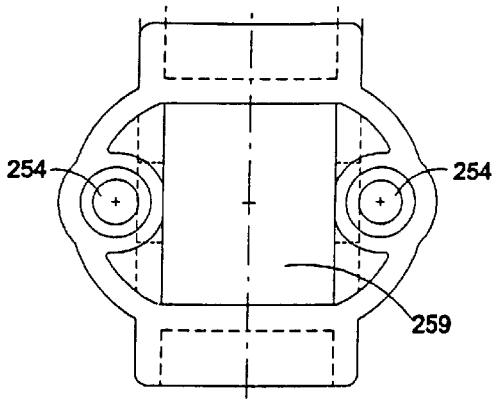
FIG. 44 is a top view of the wheel support of the present invention with dual pivotal provisions.
Figure 45:
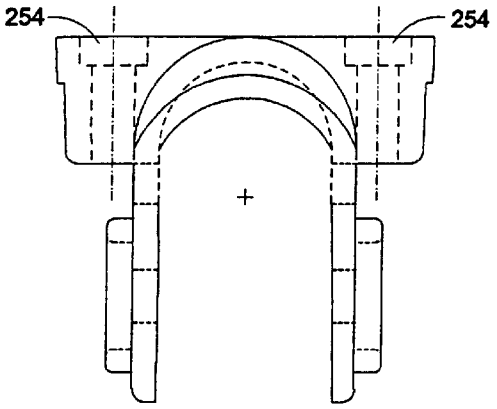
FIG. 45 is a front view of the wheel support of the present invention with dual pivotal provisions.
Figure 46:
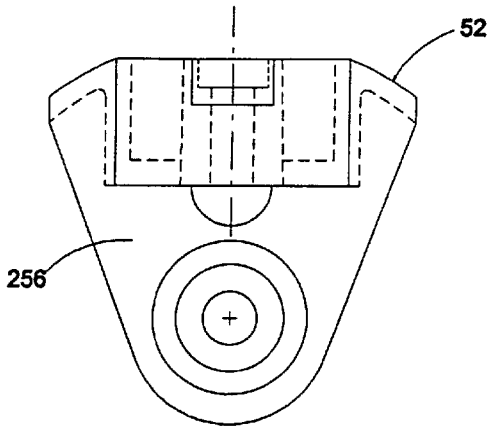
FIG. 46 is a side view of the wheel support of the present invention with dual pivotal provisions.

FIG. 43 is a side profile of a completed convertible skate assembly according to the present invention. Anchor 294 is fit in the space between two wheel supports and holds the yoke-chassis 210 tight against post-base 234. Fasteners 220 and 224 permanently attach the assembly to the base of a foot enclosure or a show enclosure. Pin 298 is used to ensure the anchor is retained in its engaged position with respect to fixed member 271 of post-base 244. This in conjunction with spring mechanism 290 (see FIG. 31) allows quick converting from one skate arrangement to another. Once a skate arrangement is selected, fastener 236 can be tightened to secure anchor 294 so as to hold wheel supports 52 and yoke-chassis 210 tightly against post-base 244.

Figure 47:
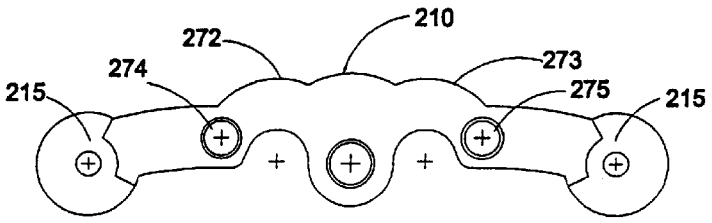
FIG. 47 is a top plan view of the yoke-chassis of the present invention.
Figure 48:
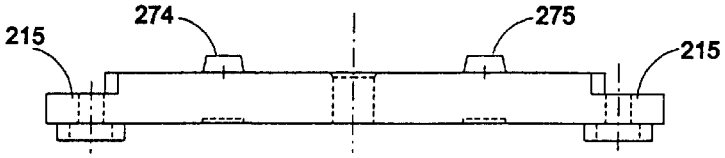
FIG. 48 is a side view of the yoke-chassis of the present invention.
Figure 49:
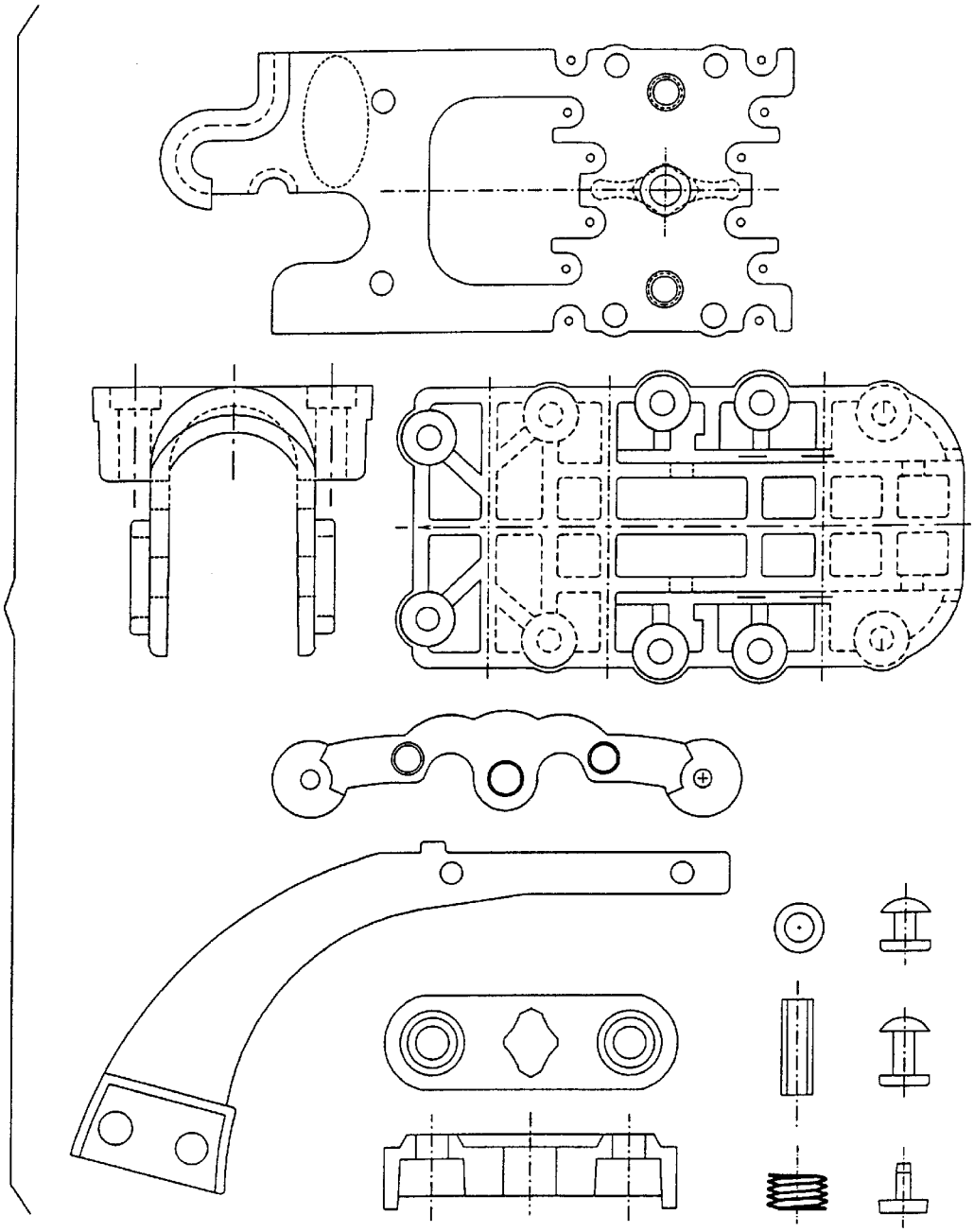
FIG. 49 is a consolidated summary of skate components relating to the present invention.

Additional details of the wheel support and the yoke-chassis are shown in FIGS. 44–48. Dual pivotal provisions 254 of wheel support 52 are spaced according to the width of the wheel so that maximum support can be obtained to resist side moment. Top 259 of wheel support 52 is open to minimizes the distance from the top of a wheel to the bottom of a skate enclosure. FIGS. 47–48 show yoke-chassis 210 with protrusions 272 and 273 and alignment lugs 274 and 275. Protrusions 272 and 273 provide a physical barrier to rotation by limiting the range of motion of yoke-chassis 210. Lugs 274 and 275 engage apertures 278 and 279 to positively locate the angular position of yoke-chassis 210.

The present invention comprises, in one form thereof, a skate with a post-base (234), at least two wheels (50), and a yoke-chassis (210) attached to the post-base and rotatably supporting the wheels, which is characterized by a positioning mechanism. The wheels are oriented by the position mechanism in one of at least two arrangements, a first in-line arrangement and a second parallel arrangement. The post-base includes a post (230) extending from a bottom surface of the post-base, and fixed members (271) located proximate the post. Each yoke-chassis (210) is pivotably disposed about one of the fixed members and is capable of pivotable movement about the post.

The present invention utilizes a yoke-chassis mounted on fixed members proximate the post extending from a bottom surface of the post-base. The yoke-chassis supports the wheels by the wheel supports and is capable of pivotable movement about the post. The post-base can be readily attached to the bottom of a foot or shoe enclosure.

The post includes a fastener and an anchor, and the skate further comprises a threaded portion of the post to rotationally secure the position of the yoke-chassis. The anchor has receptacles which may also include a portion of enlarged diameter supporting a spring mechanism which biases the yoke-chassis into the post-base.

One embodiment of the connecting mechanism includes two yoke-chassis (210) connecting the fixed member (271) proximate the post and the wheels. The yoke-chassis have a predetermined length maintaining the angular position of the wheels relative to the post regardless of the angular position of the yoke-chassis. A pair of yoke-chassis is used for a respective pair of wheels. One yoke-chassis functions as a chassis while the other functions as a connecting means. The same connecting means also serves as positioning mechanism which provides for the wheels to be maintained in an angular position corresponding to the longitudinal direction of the post-base throughout the rotation of the yoke-chassis.

As positioning mechanism the yoke-chassis positions the pair of wheel supports which are supported by the yoke-chassis. The yoke-chassis is rotatable between at least two positions, and the connection of the wheels to the fixed members of the post-base through the positioning mechanism of the yoke-chassis ensures that the angular orientation of the wheels are maintained.

By rotating the wheels and the yoke-chassis, the wheels may be positioned either in an in-line arrangement, where the planes of the wheels are coextensive, or a parallel arrangement, wherein the wheels are parallel to the longitudinal center of the post-base and are coaxial.

The present invention also includes brake mounting mechanism (222) with brake support (226) as shown in FIGS. 35–37. The brake mounting mechanism can be retained in between the heel spacer and the post-base. The braking action is conveniently achieved by the skater's inclining skate 2 so that the brake contacts the surface over which skate 2 is traversing. In the in-line arrangement, the braked is located at the very end of the skate in-line with the wheels. In the parallel arrangement, the brake is located in between the two rear wheels.

Another feature of the invention involves aligning mechanism (274, 275, 278, 279) which orients the yoke-chassis relative to the post and may define a plurality of discrete aligned positions for the yoke-chassis relative to the post.

Yet another feature of the present invention utilizes the post and the yoke-chassis to form an anti-rotation mechanism (272, 273, 276, 277) so that in a secure position for a selected skate arrangement the stability of the skate can be maximized.

By combining the yoke-chassis, the post-base, the wheel supports and the wheels into one complete assembly, many different varieties of foot or shoe enclosures may be utilized with the present invention. The post-base, the fixed members proximate the post, in conjunction with the yoke-chassis, provide enhanced support for the foot or shoe enclosure to enhance the rigidity of the foot enclosure and enhance its structural integrity.

In the exemplary embodiment, two fixed members are utilized with two corresponding yoke-chassis and each yoke-chassis supports the same side of two wheel supports. This allows for a pair of roller wheels to be deployed in one of a plurality of positions, which may be readily converted form a parallel arrangement to an in-line arrangement, or vice versa.

One method of effecting the convertible changes is by loosening the fastener engaging the anchor against the yoke-chassis. By turning the yoke-chassis to desired position and then retightening the fastener, one could select from a plurality of pre-determined skate configuration arrangements. Another method involves the use of a spring biasing mechanism for releasing and securing the yoke-chassis. The spring mechanism can be used as a supplement to the fastener, therefore the two methods can actually be employed simultaneously in a given convertible skate design.

While this invention has been described as having a preferred design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A convertible skate comprising:

a post-base including a pair of fixed members;

a first and second wheel, each of said first and second wheel with a corresponding wheel support;

a first and second yoke-chassis attached to said post-base, each of said first and second yoke-chassis being attached to a corresponding one of said fixed members, said first yoke-chassis being connected to said first and second wheels, said second yoke-chassis being connected to said first and second wheels, said first and second yoke-chassis being structured and arranged to position said first and second wheels in one of a plurality of selective positions keeping the rotational planes of said wheels in one of a parallel arrangement and a coplanar arrangement.

2. The convertible skate of claim 1 characterized in that at least one of said fixed members includes a fastener for securing the position of a corresponding one of said yoke-chassis relative to said post-base.

3. The convertible skate of claim 2 characterized in that said at least one fixed member includes a spring mechanism biasing at least one of said yoke-chassis into said post-base.

4. The convertible skate of claim 1 characterized in that said post-base and said first and second yoke-chassis further include alignment means for aligning at least one of said yoke-chassis relative to said post-base.

5. The convertible skate of claim 1 characterized by brake mounting means attached to a top surface of said post-base and extending beyond an end of said post-base, said brake mounting means providing support for a brake.

6. The convertible skate of claim 1 characterized by a heel spacer serving to bridge the gap between the top surface of said post-base and the bottom edge of a skater's heel, said heel spacer further including securing means for securing said post-base to said heel spacer.

7. The convertible skate of claim 1 characterized in that said post-base comprises two sections having a joining portion on one end of said post-base section along the longitudinal direction of said post-base section so that when another base with similar joining portion is rotated approximately one hundred eighty degrees, said joining portions can be matched to form a post-base for extending the longitudinal dimension of the resulting post-base, said joining portion including a male protrusion and a matching female recess.

8. The convertible skate of claim 2 characterized in that said fastener further includes an anchor having a receptacle for receiving said fixed member.

9. The convertible skate of claim 1 characterized in that each of said yoke-chassis provides for synchronized orientation of said corresponding pair of said wheels, and said wheels are maintained in an angular position corresponding to the longitudinal direction of said post-base throughout the rotation of said yoke-chassis.

10. A convertible skate comprising:

a first and second post-base each including a pair of fixed members;

a first and second pair of yoke-chassis attached to a corresponding one of said first and second post-base, each one of said yoke-chassis being attached to a corresponding one of said fixed members, each one of said yoke-chassis including a pair of wheel supports with a corresponding pair of wheels, each one of said wheel supports rotatably supporting one of said corresponding wheels, each one of said first and second pair of yoke-chassis being structured and arranged to position said corresponding pair of said wheels in one of a plurality of selective positions separately and independently of the other of said first and second pair of yoke-chassis.

11. The convertible skate of claim 10 characterized in that at least one of said fixed members includes a fastener for securing the position of a corresponding one of said yoke-chassis relative to said post-base.

12. The convertible skate of claim 10 characterized in that said fixed member includes a spring mechanism biasing at least one of said yoke-chassis into said post-base.

13. The convertible skate of claim 10 characterized in that said post-base and said first and second yoke-chassis further include alignment means for aligning at least one of said yoke-chassis relative to said post-base.

14. The convertible skate of claim 10 characterized by brake mounting means attached to a top surface of said post-base and extending beyond an end of said post-base, said brake mounting means providing support for a brake.

15. The convertible skate of claim 10 characterized by a heel spacer serving to bridge the gap between the top surface of said post-base and the bottom edge of a skater's heel, said heel spacer further including securing means for securing said post-base to said heel spacer.

16. The convertible skate of claim 10 characterized in that said post-base comprises two sections having a joining portion on one end of said post-base section along the longitudinal direction of said post-base section so that when another base with similar joining portion is rotated approximately one hundred eighty degrees, said joining portions can be matched to form a post-base for extending the longitudinal dimension of the resulting post-base, said joining portion including a male protrusion and a matching female recess.

17. The convertible skate of claim 11 characterized in that said fastener further includes an anchor having a receptacle for receiving said fixed member.

18. The convertible skate of claim 10 characterized in that each of said yoke-chassis provides for synchronized orientation of said corresponding pair of said wheels, and said wheels are maintained in an angular position corresponding to the longitudinal direction of said post-base throughout the rotation of said yoke-chassis.

* * * * *